US006414907B1

(12) United States Patent
Pennington

(10) Patent No.: US 6,414,907 B1
(45) Date of Patent: Jul. 2, 2002

(54) ATHLETIC EVENT SCHEDULE WATCH

(76) Inventor: B. Carter Pennington, 50538 Pine Row Ct., Granger, IN (US) 46530

( * ) Notice: Subject to any disclaimer, the term of this patent is extended or adjusted under 35 U.S.C. 154(b) by 0 days.

(21) Appl. No.: 09/924,347

(22) Filed: Aug. 8, 2001

Related U.S. Application Data

(63) Continuation of application No. 08/724,363, filed on Oct. 1, 1996.

(51) Int. Cl.[7] ..... G04B 47/00; G04B 19/24; G04B 45/00; G04C 19/00; G09G 5/00

(52) U.S. Cl. ..... 368/10; 368/28; 368/41; 368/82; 345/809; 345/841; 345/844; 708/110; 708/112

(58) Field of Search ..... 368/10, 28, 29, 368/41, 43, 82–84, 223, 239–241; 345/809, 841, 844, 784; 463/1; 700/91; 708/110–112

(56) References Cited

U.S. PATENT DOCUMENTS 5,165,012 A * 11/1992 Crandall ..... 395/100
5,199,009 A * 3/1993 Svast ..... 368/240
5,220,540 A * 6/1993 Nishida et al. ..... 368/41
5,623,613 A * 4/1997 Rowe et al. ..... 395/353
5,635,978 A * 6/1997 Alten et al. ..... 368/7
5,653,634 A * 8/1997 Hodges ..... 463/1

* cited by examiner

*Primary Examiner*—Vit Miska
(74) *Attorney, Agent, or Firm*—Baker & Daniels

(57) ABSTRACT

A portable electronic device for displaying daily schedule information of a particular event and selectively displaying past and future schedule information which includes a display controlled by a processor having an internal programmable memory. The schedule information includes the location of the event, the start time, and the corresponding time zone. The memory contains data representing the event's schedule and a program for controlling the processor. The display provides actual time and date information and schedule information corresponding to the displayed calendar day. By manipulating a plurality of externally mounted push-button switches, the user commands the processor to update the display with schedule information corresponding to past and future days. A programmable alarm provides an audible reminder when a scheduled event begins.

3 Claims, 13 Drawing Sheets

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| 000 | 4D | 91 | 45 | ED | 45 | D4 | 45 | D4 | - | 45 | EB | 45 | DB | 45 | D4 | FF | FF |
| 010 | FF | FF | FF | FF | FF | FF | FF | FF | - | FF | FF | FF | FF | FF | FF | FF | FF |
| 020 | FF | 90 | FE | 90 | 48 | EE | 04 | EB | - | 04 | AA | 44 | EB | DC | 98 | 0B | E0 |
| 030 | DC | 94 | D9 | 00 | D9 | 10 | D9 | 20 | - | D9 | 80 | 4E | 40 | 82 | 82 | DC | F2 |
| 040 | DC | F4 | DC | 00 | 4B | 54 | DD | 50 | - | DD | 51 | 48 | 70 | FF | FF | FF | FF |
| 050 | FF | FF | FF | FF | FF | FF | FF | FF | - | FF | FF | FF | FF | FF | FF | FF | FF |
| 060 | FF | FF | FF | FF | FF | FF | FF | FF | - | FF | FF | FF | FF | FF | FF | FF | FF |
| 070 | FF | FF | FF | FF | FF | FF | FF | FF | - | FF | FF | FF | FF | FF | FF | FF | FF |
| 080 | 96 | B8 | D0 | E8 | CC | C5 | FF | FF | - | FF | FF | FF | FF | FF | FF | FF | FF |
| 090 | FF | FF | FF | FF | FF | FF | FF | FF | - | FF | FF | FF | FF | FF | FF | FF | FF |
| 0A0 | FF | FF | FF | FF | FF | FF | FF | FF | - | FF | FF | FF | FF | FF | FF | FF | FF |
| 0B0 | FF | FF | FF | FF | FF | FF | FF | FF | - | 00 | 10 | 07 | 30 | 09 | 01 | 00 | 01 |
| 0C0 | 54 | 02 | 00 | FF | FF | FF | FF | FF | - | FF | FF | FF | FF | FF | FF | FF | FF |
| 0D0 | FF | FF | FF | FF | FF | FF | FF | FF | - | FF | FF | FF | FF | FF | FF | FF | FF |
| 0E0 | FF | FF | FF | FF | FF | FF | FF | FF | - | FF | FF | FF | FF | FF | FF | FF | FF |
| 0F0 | FF | FF | FF | FF | FF | FF | FF | FF | - | FF | FF | FF | FF | FF | FF | FF | FF |
| 100 | 11 | 61 | 07 | 35 | 12 | 81 | 07 | 35 | - | 13 | A1 | 07 | 05 | 14 | C1 | 01 | 35 |
| 110 | 15 | 02 | 07 | 05 | 16 | 22 | 07 | 05 | - | 17 | 42 | 07 | 05 | 18 | 63 | 47 | 05 |
| 120 | 19 | 83 | 47 | 05 | 20 | A3 | 52 | 05 | - | 21 | C3 | 41 | 05 | 62 | 04 | 07 | 35 |
| 130 | 63 | 24 | 07 | 35 | 64 | 44 | 01 | 05 | - | 65 | 65 | 07 | 35 | 66 | 85 | 07 | 35 |
| 140 | 67 | A5 | 02 | 05 | 68 | C5 | 01 | 35 | - | 30 | 24 | 47 | 35 | 31 | 44 | 47 | 35 |
| 150 | FF | FF | FF | FF | 01 | 64 | 47 | 35 | - | 02 | 85 | 47 | 05 | 03 | A5 | 47 | 05 |
| 160 | 04 | C5 | 41 | 35 | 05 | 05 | 47 | 05 | - | 46 | 27 | 07 | 35 | 47 | 47 | 07 | 35 |
| 170 | 48 | 67 | 01 | 05 | 49 | 88 | 07 | 35 | - | 50 | A8 | 01 | 35 | 51 | C8 | 01 | 35 |
| 180 | 12 | 07 | 47 | 05 | 13 | 27 | 47 | 05 | - | 14 | 47 | 41 | 05 | 56 | 89 | 07 | 35 |
| 190 | 57 | A9 | 01 | 35 | 58 | C9 | 01 | 35 | - | 59 | 09 | 07 | 35 | 60 | 2A | 07 | 35 |
| 1A0 | 61 | 4A | 07 | 35 | 62 | 6A | 01 | 05 | - | 63 | 8B | 07 | 35 | 64 | AB | 01 | 35 |
| 1B0 | 65 | CB | 01 | 35 | 26 | 09 | C7 | 05 | - | 27 | 29 | C7 | 05 | 28 | 49 | D2 | 35 |
| 1C0 | 29 | 6A | C7 | 05 | 30 | 8A | C7 | 05 | - | 31 | AA | C7 | 05 | FF | CC | C5 | FF |
| 1D0 | FF | FF | FF | FF | FF | FF | FF | FF | - | FF | FF | FF | FF | FF | FF | FF | FF |
| 1E0 | FF | FF | FF | FF | FF | FF | FF | FF | - | FF | FF | FF | FF | FF | FF | FF | FF |
| 1F0 | FF | FF | FF | FF | FF | FF | FF | FF | - | FF | FF | FF | FF | FF | FF | FF | FF |
| 200 | 01 | CA | C1 | 05 | 02 | 0B | C1 | 05 | - | 03 | 2B | C7 | 05 | 04 | 4B | C7 | 35 |
| 210 | 46 | 8C | 07 | 35 | 47 | AC | 01 | 35 | - | 48 | CC | 01 | 35 | 10 | 28 | 07 | 05 |
| 220 | 11 | 48 | 07 | 05 | 12 | 68 | 07 | 05 | - | 13 | 8C | 07 | 35 | 14 | AC | 01 | 35 |
| 230 | 15 | CC | 01 | 35 | 16 | 0C | 07 | 35 | - | 57 | 21 | 07 | 35 | 58 | 41 | 07 | 35 |
| 240 | 59 | 61 | 07 | 35 | 60 | 82 | 07 | 35 | - | 61 | A2 | 01 | 35 | 62 | C2 | 01 | 35 |
| 250 | 64 | 23 | 07 | 35 | 65 | 43 | 07 | 35 | - | 26 | 62 | 07 | 05 | 27 | 82 | 07 | 05 |
| 260 | 28 | A2 | 01 | 05 | A9 | C2 | 01 | 05 | - | FF | FF | FF | FF | CC | C5 | 7A | FE |
| 270 | 3D | 48 | 50 | 61 | 50 | D0 | D0 | 6C | - | EC | EC | 7A | FE | 3D | 48 | 50 | 61 |
| 280 | 50 | D0 | D0 | D0 | D0 | FE | 48 | 4D | - | 48 | 61 | 5B | 50 | 48 | C8 | 5B | 6C |
| 290 | EC | EC | 48 | C8 | 48 | 48 | 40 | 3D | - | 6C | 40 | 48 | 50 | 61 | 6C | 7A | FE |
| 2A0 | 7A | 48 | 50 | 61 | 50 | D0 | D0 | 6C | - | EC | EC | 7A | FA | 6C | 61 | 5B | 50 |
| 2B0 | 48 | C8 | C8 | C8 | 48 | 40 | 3D | BD | - | BD | 3D | BD | BD | 3D | 40 | 48 | 50 |
| 2C0 | 56 | 50 | 48 | C8 | C8 | 40 | C0 | C0 | - | 3D | BD | BD | BD | FF | FF | FF | FF |
| 2D0 | FF | FF | FF | FF | FF | FF | FF | FF | - | FF | FF | FF | FF | FF | FF | FF | FF |
| 2E0 | FF | FF | FF | FF | FF | FF | FF | FF | - | FF | FF | FF | FF | FF | FF | FF | FF |
| 2F0 | FF | FF | FF | FF | FF | FF | FF | FF | - | FF | FF | FF | FF | FF | FF | FF | FF |

FIG. 9

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| 300 | 00 | 00 | 00 | 00 | 00 | 07 | 0A | 12 | - | 0A | 07 | 11 | 1F | 15 | 15 | 0A | 0E |
| 310 | 11 | 11 | 11 | 11 | 11 | 1F | 11 | 11 | - | 0E | 1F | 15 | 15 | 15 | 11 | 1F | 14 |
| 320 | 14 | 14 | 10 | 0E | 11 | 11 | 15 | 17 | - | 1F | 04 | 04 | 04 | 1F | 00 | 11 | 1F |
| 330 | 11 | 00 | 02 | 11 | 11 | 1E | 10 | 1F | - | 04 | 04 | 0A | 11 | 1F | 01 | 01 | 01 |
| 340 | 01 | 1F | 08 | 04 | 08 | 1F | 1F | 08 | - | 04 | 02 | 1F | 0E | 11 | 11 | 11 | 0E |
| 350 | 1F | 14 | 14 | 14 | 08 | 0E | 11 | 15 | - | 12 | 0D | 1F | 14 | 14 | 16 | 09 | 09 |
| 360 | 15 | 15 | 15 | 12 | 10 | 10 | 1F | 10 | - | 10 | 1E | 01 | 01 | 01 | 1E | 18 | 06 |
| 370 | 01 | 06 | 18 | 1E | 01 | 06 | 01 | 1E | - | 11 | 0A | 04 | 0A | 11 | 10 | 08 | 07 |
| 380 | 08 | 10 | 11 | 13 | 15 | 19 | 11 | 1D | - | 15 | 17 | 00 | 1F | 15 | 15 | 00 | 1F |
| 390 | 14 | 1F | 00 | 1D | 15 | 17 | 00 | 1F | - | 11 | 1F | 00 | 1F | 10 | 1F | 00 | 44 |
| 3A0 | 8C | 51 | 83 | BC | 85 | 87 | 20 | 89 | - | 60 | 81 | E8 | CD | 68 | 93 | CE | 20 |
| 3B0 | C1 | BA | 21 | 81 | 01 | 83 | 51 | F8 | - | 21 | 81 | 08 | CD | 0C | 81 | B0 | CD |
| 3C0 | 0A | 20 | 44 | C0 | 60 | DC | FC | 26 | - | 26 | 30 | 81 | FB | CD | 68 | CC | C2 |
| 3D0 | 60 | 81 | 00 | C4 | 82 | 8D | DD | 1E | - | D9 | 01 | DD | 21 | C4 | 82 | 84 | CA |
| 3E0 | 68 | 93 | CE | CA | 69 | 93 | CE | 43 | - | 21 | C0 | 51 | C5 | FF | FF | FF | FF |
| 3F0 | FF | FF | FF | FF | FF | FF | FF | FF | - | FF | FF | FF | FF | FF | FF | FF | FF |
| 400 | CE | 6A | 37 | 8C | 34 | D9 | 09 | 85 | - | 0D | 30 | 30 | DD | 64 | 9E | 40 | 95 |
| 410 | 14 | 98 | 21 | 95 | 45 | 95 | 49 | 94 | - | 4B | 95 | 2E | 95 | 60 | 95 | 64 | 95 |
| 420 | 4F | 97 | A6 | 4E | EE | 62 | 0E | 06 | - | 48 | 68 | 62 | AE | 00 | 66 | EE | 0A |
| 430 | 68 | 0E | 48 | 68 | 68 | 26 | 06 | 8E | - | E0 | 4C | 06 | 00 | AC | E2 | 68 | 48 |
| 440 | 08 | AC | 62 | 62 | 0E | 06 | 00 | 00 | - | 00 | 00 | 00 | 8D | 89 | 08 | 20 | 44 |
| 450 | D9 | 09 | 40 | 26 | 26 | DC | 9C | 85 | - | 23 | 30 | BC | 89 | 68 | 83 | B9 | CC |
| 460 | 84 | CD | 62 | EC | 73 | 8C | 63 | EC | - | 73 | CA | 68 | 94 | 5F | CC | EC | 73 |
| 470 | 21 | 43 | C5 | DD | 06 | B1 | 39 | DC | - | 2E | C4 | 36 | C5 | A6 | 06 | 00 | 06 |
| 480 | E2 | 04 | E0 | 06 | 44 | 06 | E4 | 02 | - | E6 | 02 | 80 | 06 | E6 | 06 | E4 | 06 |
| 490 | 00 | 00 | E6 | 00 | A6 | 00 | 0E | 06 | - | C6 | 04 | AF | A0 | CB | E9 | E4 | 6D |
| 4A0 | 6F | A8 | EF | ED | 00 | 4F | 0F | B6 | - | CE | 4E | CD | 0A | 8D | 89 | 08 | 20 |
| 4B0 | 44 | D9 | 09 | 26 | C9 | 7C | 40 | CC | - | CD | 62 | D9 | B3 | 1B | D9 | 32 | 18 |
| 4C0 | F3 | 62 | 13 | F1 | B3 | 12 | F0 | B3 | - | DD | 16 | DD | 06 | 8D | DD | 19 | DC |
| 4D0 | 2E | C4 | 36 | 8D | DD | 11 | DD | 06 | - | 8C | 63 | DC | 2E | C4 | 36 | 8D | DD |
| 4E0 | 19 | DD | 06 | 84 | CC | DC | 2E | C4 | - | 21 | 43 | C5 | CD | 0A | 8D | F2 | 3F |
| 4F0 | BA | 89 | 08 | 20 | 44 | D9 | 09 | C9 | - | 9A | C8 | C4 | 36 | B1 | 39 | C4 | DD |
| 500 | 09 | 89 | 62 | DD | 1E | C2 | 62 | 13 | - | C0 | FD | 12 | C1 | FD | 3A | C4 | 21 |
| 510 | F0 | 3F | 43 | C5 | 2B | D9 | EA | DB | - | 48 | 21 | 2A | 20 | F1 | CF | 21 | DC |
| 520 | 08 | 20 | D9 | 11 | 13 | F1 | B7 | 12 | - | F0 | B7 | 21 | 81 | CB | 24 | DC | 08 |
| 530 | 20 | D9 | 11 | 13 | F1 | E9 | 12 | F0 | - | E9 | 21 | 81 | E9 | 24 | 81 | D7 | EC |
| 540 | AA | 82 | 81 | D1 | 24 | CE | 6A | 37 | - | 09 | CE | 6A | 37 | 81 | D7 | 24 | 83 |
| 550 | 29 | 81 | B3 | 24 | 81 | F3 | 25 | 82 | - | 8D | 31 | 12 | F1 | 3F | 81 | EF | 23 |
| 560 | CE | 6A | 37 | 09 | CE | 6A | 37 | 81 | - | F3 | 23 | 19 | 01 | 0E | 02 | 01 | 0C |
| 570 | 02 | 0F | 13 | 0D | 09 | 0C | 14 | 05 | - | 18 | 0B | 01 | 0E | 14 | 05 | 18 | 03 |
| 580 | 08 | 09 | 04 | 05 | 14 | 13 | 05 | 01 | - | 03 | 01 | 0C | 0F | 01 | 0B | 14 | 0F |
| 590 | 12 | 04 | 01 | 19 | 01 | 0C | 0D | 42 | - | 83 | 32 | ED | 14 | 83 | 30 | ED | 3D |
| 5A0 | 81 | 0E | C1 | 51 | EB | 9F | 40 | 26 | - | 30 | 81 | 6A | 30 | 81 | BC | CD | 4E |
| 5B0 | CC | CD | 0C | CE | 4E | EB | BF | CE | - | 4E | C9 | 0C | 84 | 31 | 95 | AE | C5 |
| 5C0 | 29 | BF | 89 | 40 | 81 | 0D | CD | 96 | - | 81 | 6C | CD | 90 | FF | 9C | FF | 98 |
| 5D0 | F1 | 85 | 28 | C5 | FE | BE | FE | 9B | - | C1 | 36 | D5 | FE | B2 | 29 | CA | 40 |
| 5E0 | 1A | BF | 89 | 40 | E7 | F7 | C3 | FC | - | C3 | FF | B2 | 28 | D5 | E3 | 36 | 15 |
| 5F0 | E0 | 36 | F1 | 36 | 12 | E1 | 36 | D5 | - | C1 | 50 | 81 | 0D | CD | 5E | 12 | D1 |

FIG. 10

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| 600 | 50 | B0 | 89 | 51 | 89 | 54 | 81 | FF | - | CD | 52 | BA | 89 | 59 | C5 | CE | 60 |
| 610 | 40 | 87 | 21 | 8C | 62 | 14 | 87 | 21 | - | 8C | 7C | D9 | 09 | 26 | DC | 9E | DD |
| 620 | 60 | 90 | 84 | 91 | CD | 92 | 6C | EB | - | 9F | 1B | D2 | 50 | 0A | C3 | 50 | EB |
| 630 | AF | CE | 5E | ED | A2 | 8C | 51 | DD | - | 18 | 20 | 31 | 13 | C0 | EC | 12 | C1 |
| 640 | EC | 21 | 83 | 54 | DC | 08 | 20 | D9 | - | 11 | 13 | E1 | EC | 12 | E0 | EC | 21 |
| 650 | 81 | EE | 25 | 83 | 52 | 81 | F6 | 25 | - | 82 | 81 | F2 | 25 | 8D | 20 | D9 | F0 |
| 660 | 13 | C0 | F1 | 12 | C1 | F1 | 21 | D2 | - | 50 | 96 | 7C | C2 | 50 | 96 | 7C | 83 |
| 670 | 59 | 81 | FA | 25 | 8D | 31 | C5 | 20 | - | C1 | FD | 21 | C5 | 20 | C0 | BA | C0 |
| 680 | FD | B0 | 89 | FA | 89 | FC | 21 | 81 | - | 00 | 93 | BB | 00 | 03 | 06 | 01 | CE |
| 690 | 26 | CD | 56 | CE | 2A | CD | 5A | CE | - | 2C | CD | 5C | 81 | 07 | DD | 06 | 89 |
| 6A0 | 58 | 37 | CE | 5A | DC | BA | 12 | 96 | - | CF | DD | 06 | 85 | 04 | DC | BC | 96 |
| 6B0 | CF | 85 | 8B | DD | 0E | D9 | 09 | DC | - | 9C | C8 | 37 | CE | 56 | DC | 9A | DC |
| 6C0 | D8 | 83 | 58 | DD | 06 | 3D | 0C | AA | - | A0 | 49 | 08 | DD | 0E | 89 | 58 | B0 |
| 6D0 | 89 | 50 | CE | 5C | 37 | CE | 70 | DC | - | BA | 12 | 95 | FF | 83 | 00 | DC | EA |
| 6E0 | 95 | FF | CE | 78 | 40 | CE | 5A | DC | - | BC | 12 | 96 | F9 | DC | EA | 95 | FF |
| 6F0 | CE | 76 | 40 | CE | 56 | DC | BC | 95 | - | FF | CE | 5A | 40 | CE | 74 | DC | BC |
| 700 | 12 | 97 | 10 | DC | EA | 95 | FF | CE | - | 56 | 40 | CE | 72 | DC | BC | 95 | FF |
| 710 | CE | 74 | 40 | CE | 5A | DC | BC | 26 | - | 40 | CE | 7A | 30 | EE | 16 | 89 | 62 |
| 720 | 84 | EE | 16 | CD | 60 | 16 | CE | 60 | - | C9 | 04 | CD | 60 | EE | 0E | 87 | 3F |
| 730 | DC | 1E | 37 | CE | 56 | DC | BA | 12 | - | 95 | F8 | 83 | 00 | DC | EA | 97 | 26 |
| 740 | EE | 0E | DD | 09 | DD | 1C | 89 | 51 | - | CA | 60 | EE | 0E | CD | 5E | DD | 09 |
| 750 | DD | 11 | 89 | 5F | DD | 09 | E6 | 88 | - | 89 | 58 | CA | 60 | EE | 0E | CD | 54 |
| 760 | DD | 09 | DD | 13 | 89 | 55 | DD | 09 | - | 88 | 88 | DD | 13 | AB | 89 | 59 | CA |
| 770 | 60 | EE | 0E | CD | 52 | B0 | 89 | 50 | - | C5 | DC | 08 | 58 | D9 | A0 | 17 | B0 |
| 780 | 59 | D9 | A1 | 12 | D9 | 09 | 41 | C5 | - | FE | B7 | EF | 8F | FE | 87 | C5 | BF |
| 790 | 31 | A0 | 48 | 0C | C5 | 35 | 82 | ED | - | 3D | 82 | ED | 14 | 36 | ED | 54 | 82 |
| 7A0 | EC | 4B | 36 | ED | 2E | 36 | 81 | FB | - | 25 | 82 | 81 | F7 | 23 | F3 | 2F | C5 |
| 7B0 | C2 | 3F | 94 | 00 | 8C | 34 | 33 | 17 | - | 20 | F0 | E7 | F0 | E3 | 21 | C5 | CE |
| 7C0 | 6A | 37 | DC | 08 | E3 | 2F | 8D | 29 | - | 81 | AA | E3 | 2F | 12 | 41 | 19 | 8C |
| 7D0 | 34 | D9 | 50 | 12 | B7 | 11 | BA | C4 | - | EC | 00 | 28 | E3 | 2F | 12 | 41 | C5 |
| 7E0 | C4 | C5 | FF | FF | FF | FF | FF | FF | - | FF | FF | FF | FF | FF | FF | FF | FF |
| 7F0 | FF | FF | FF | FF | FF | FF | FF | FF | - | FF | FF | FF | FF | FF | FF | FF | FF |
| 800 | 00 | 32 | 29 | 32 | 31 | 32 | 31 | 32 | - | 32 | 31 | 00 | 00 | 00 | 00 | 00 | 00 |
| 810 | 32 | 31 | 32 | 60 | 60 | 12 | 29 | 13 | - | 10 | 00 | 00 | 12 | 01 | 01 | 10 | CC |
| 820 | C5 | F9 | 2E | 16 | 20 | F1 | E7 | F0 | - | E3 | 15 | 20 | F1 | E3 | F0 | E7 | 21 |
| 830 | C5 | CD | 6A | E1 | 2F | CE | 6A | 37 | - | EC | 00 | 22 | CE | 6A | 37 | 8C | 3A |
| 840 | 32 | 98 | 51 | CE | 6E | DC | 09 | 15 | - | CE | 6C | 41 | 98 | 35 | EF | 79 | 98 |
| 850 | 35 | 33 | 98 | 6A | CE | 6C | DC | 09 | - | 15 | CE | 6E | 41 | 98 | 35 | DC | 08 |
| 860 | 48 | 15 | B9 | 49 | 12 | D9 | 99 | 41 | - | 98 | 35 | 34 | 12 | 94 | 00 | 98 | 3A |
| 870 | CD | 6A | E0 | 2F | CE | 6A | 37 | EC | - | 00 | 22 | CE | 6A | 37 | 8C | 3A | 32 |
| 880 | 98 | 95 | 8C | 6E | 38 | 15 | 8C | 6C | - | C4 | 98 | 74 | 8D | 58 | D9 | A0 | 12 |
| 890 | 8C | 6C | C4 | 98 | 74 | 33 | 98 | A6 | - | 8C | 6C | 38 | 15 | 8C | 6E | C4 | 9B |
| 8A0 | 74 | 8D | 48 | C4 | 98 | 74 | 34 | 12 | - | 94 | 00 | 98 | 74 | C1 | 67 | B5 | 89 |
| 8B0 | 66 | ED | 97 | 22 | 8C | 3A | 34 | 11 | - | 27 | 32 | 98 | D0 | 8C | 3E | DD | 38 |
| 8C0 | 89 | 3E | 20 | 8C | EC | DD | 38 | 89 | - | EC | DD | 1A | 89 | 3C | 21 | 98 | B3 |
| 8D0 | 33 | 98 | E0 | 8C | 3E | DD | 32 | 89 | - | 3E | 20 | 8C | EC | DD | 32 | 98 | C7 |
| 8E0 | D9 | 40 | 19 | F1 | 2F | B1 | 89 | 34 | - | 9C | 92 | 9C | 92 | 98 | AC | C2 | 39 |
| 8F0 | 99 | 04 | F2 | 3D | 1F | E2 | 3D | 1C | - | F0 | 36 | FE | C3 | FE | 9C | FE | 98 |

FIG. 11

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| 900 | FF | 87 | EF | 8F | 44 | F3 | 7D | 16 | - | C2 | 39 | 13 | FF | B3 | 12 | FF | A3 |
| 910 | A0 | A0 | A0 | FD | 8A | 9A | 4E | DD | - | 67 | 43 | EF | AD | DD | 66 | E2 | 3D |
| 920 | ED | C0 | D9 | 3B | FD | 0F | 11 | 14 | - | C1 | 3F | 9A | 4E | 43 | C3 | 67 | 99 |
| 930 | 3E | CA | 66 | 1A | BA | 89 | 34 | 83 | - | 34 | 81 | B3 | EC | AA | 27 | B0 | 89 |
| 940 | 37 | 85 | 12 | 87 | 18 | 83 | 20 | 84 | - | 86 | EF | 79 | 2D | 85 | 13 | CE | 24 |
| 950 | DC | EC | 14 | 81 | 01 | CD | 24 | 2C | - | D9 | 22 | 10 | D9 | 62 | 14 | F1 | 2E |
| 960 | 99 | 90 | DB | 48 | 1F | DC | 09 | 99 | - | AB | DC | FE | 2D | DC | F4 | DB | 48 |
| 970 | 1F | 2C | 41 | D9 | 42 | 18 | E7 | F7 | - | 2E | FC | 2E | E2 | 2E | 15 | C3 | 35 |
| 980 | 14 | F2 | 2F | 99 | AB | D9 | 62 | 11 | - | 36 | 36 | D9 | E2 | 11 | 05 | 99 | 47 |
| 990 | 8C | 28 | 58 | D9 | 70 | 11 | B0 | 89 | - | 28 | F1 | 37 | 2D | CE | 2A | 85 | 00 |
| 9A0 | DC | 94 | DB | 48 | 1F | 2C | DC | 09 | - | 12 | 99 | 69 | CE | 20 | 83 | 00 | DC |
| 9B0 | EA | 9A | 33 | F3 | 2E | 19 | EE | 8F | - | C3 | 35 | 14 | F3 | 2F | EE | 2A | F0 |
| 9C0 | 2E | 8C | 7D | 31 | 9A | 44 | C3 | 35 | - | 14 | F2 | 2F | 9A | 33 | D3 | 3E | 9A |
| 9D0 | 11 | CE | 52 | 83 | 22 | DC | 09 | 9A | - | 11 | CE | 54 | 83 | 12 | DC | EA | 12 |
| 9E0 | 81 | 00 | C9 | 12 | 40 | 8C | 59 | D9 | - | 09 | DC | 9C | DC | F6 | CE | 24 | DC |
| 9F0 | EA | 12 | 81 | 00 | E2 | 2E | C9 | 12 | - | 40 | 8C | 29 | D9 | 09 | DC | 9C | DC |
| A00 | EE | 9A | 11 | F1 | 3D | 81 | 6E | CD | - | 64 | EF | 88 | F1 | 85 | EF | 98 | 9A |
| A10 | 33 | F3 | 3E | 9A | 33 | CE | 22 | 83 | - | 30 | DC | 09 | 9A | 33 | CE | 24 | 83 |
| A20 | 32 | DC | 09 | 9A | 33 | E7 | F7 | 2E | - | 4B | F7 | 2E | D7 | 16 | E1 | 3D | EF |
| A30 | 88 | ED | C0 | C3 | 35 | 9A | 44 | 35 | - | CE | 20 | 87 | 00 | DC | EE | 9A | 44 |
| A40 | F3 | 2F | EF | 96 | 44 | CE | 20 | 87 | - | 15 | DC | EE | 12 | E0 | 3D | C3 | 36 |
| A50 | 9A | B6 | C0 | 36 | 8C | 3D | DD | 1C | - | 31 | 9A | 65 | EF | 88 | F1 | 85 | FF |
| A60 | 98 | 85 | F0 | 87 | 00 | 86 | 0E | 84 | - | 0C | 8C | F0 | 89 | 3A | 31 | 12 | 9A |
| A70 | 9E | C1 | 39 | F1 | 39 | B8 | 89 | 38 | - | C3 | 67 | 13 | B5 | 89 | 66 | 43 | 8C |
| A80 | 3A | 34 | 9A | 8F | D2 | 7D | C5 | F2 | - | 3D | 9A | 96 | E2 | 3D | 9A | 96 | F3 |
| A90 | 2F | C5 | D9 | 40 | C5 | 27 | F0 | 3D | - | FE | 9C | E0 | 3D | 9A | B6 | 8C | F1 |
| AA0 | DD | 12 | DD | 32 | 89 | 3B | 31 | 17 | - | C0 | 39 | FF | BE | FF | 9B | 17 | B0 |
| AB0 | 89 | 3A | C1 | 39 | 43 | C5 | 8C | F0 | - | 31 | 1E | 8C | F1 | DD | 32 | DD | 12 |
| AC0 | 31 | 16 | FF | 9B | FF | BE | C0 | 39 | - | 83 | 36 | FD | 36 | 9B | 52 | E3 | 3D |
| AD0 | 18 | FE | 9C | FE | C3 | F0 | 36 | 98 | - | EE | F3 | 3D | 9B | 21 | CE | 64 | 40 |
| AE0 | C9 | 01 | CD | 64 | EA | 6C | CD | 42 | - | 85 | FF | DC | EC | 9A | FC | F0 | 3D |
| AF0 | FE | 9C | D3 | 7D | 9A | FC | FE | 9C | - | E1 | 35 | 43 | 27 | 81 | 6C | CD | 90 |
| B00 | FF | 9C | 4C | CE | 42 | DC | EC | 14 | - | FE | 9C | 9B | 21 | 85 | 80 | DC | 1C |
| B10 | D9 | 81 | 11 | 1D | BF | 89 | 40 | CE | - | 42 | CD | 96 | 81 | 6C | CD | 90 | FF |
| B20 | 9C | F3 | 39 | 9B | 52 | 8C | 3A | D9 | - | 30 | 9B | 3D | 8C | 35 | DD | 15 | 31 |
| B30 | 12 | 98 | EE | CA | 38 | 98 | EE | B4 | - | 89 | 3B | F0 | 39 | C5 | D9 | B0 | 9B |
| B40 | 52 | 8C | 35 | 32 | 98 | EE | CA | 38 | - | 19 | B8 | 89 | 3B | F0 | 39 | B8 | 89 |
| B50 | 38 | C5 | 98 | EE | 20 | 44 | 85 | 00 | - | 83 | B0 | 2B | DC | FC | 37 | 8D | 2A |
| B60 | C4 | 84 | 82 | 06 | 21 | 43 | C5 | 48 | - | 12 | B9 | 49 | CD | 56 | 9B | 9E | CE |
| B70 | 56 | 87 | 01 | DC | EE | 01 | CE | 5A | - | DC | EE | 12 | 81 | 13 | 48 | 12 | 81 |
| B80 | 09 | CD | 5A | 85 | 00 | 30 | DB | 48 | - | 1F | 9B | 67 | 83 | 56 | EF | 79 | DC |
| B90 | F6 | 85 | 00 | CE | 5A | 30 | DB | 48 | - | 1F | DC | EE | 12 | 9B | BD | E0 | 3B |
| BA0 | C1 | 67 | B5 | 89 | 66 | EE | 9B | EE | - | 2A | 83 | 56 | EF | 9D | 22 | 8C | 3A |
| BB0 | 32 | 14 | 9B | 8B | 9B | 9E | 33 | 12 | - | 9B | 6F | 34 | 9B | D1 | 81 | 01 | CD |
| BC0 | 56 | 83 | 5A | EF | 79 | 87 | 13 | DC | - | EE | 9B | 9E | 81 | 01 | CD | 5A | 9B |
| BD0 | 9E | 8C | 3B | D9 | 40 | 12 | 43 | 27 | - | 9B | AD | EE | 8F | EE | 2A | 9C | 14 |
| BE0 | CE | 26 | 37 | CE | 2A | C9 | 00 | 40 | - | DB | 48 | 1F | DC | B2 | 11 | 14 | DC |
| BF0 | D8 | CD | 26 | 43 | B0 | 89 | 7D | 89 | - | 3B | C0 | 67 | BA | 89 | 6A | 83 | 6A |

FIG. 12

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| C00 | 81 | B3 | EC | AA | 81 | 00 | CD | 80 | - | E2 | 35 | 9B | DA | D2 | 35 | 9B | DC |
| C10 | F2 | 2F | 9B | DA | F0 | 2F | B1 | 89 | - | 35 | EF | 95 | 22 | 8C | 3A | 34 | 15 |
| C20 | B2 | 89 | 35 | 98 | AC | D9 | 40 | 9C | - | 31 | F1 | 2F | 42 | 35 | EF | 96 | 9C |
| C30 | 6E | 33 | 16 | B4 | 89 | 35 | 42 | 9B | - | 6F | 32 | 16 | B4 | 89 | 35 | 42 | 9B |
| C40 | 8B | D2 | 3B | 9D | 88 | E2 | 3B | 9C | - | 4F | F2 | 3B | 9D | 7A | 9C | 1B | C0 |
| C50 | 35 | E0 | 3B | D1 | 7D | 42 | CE | 7E | - | ED | A2 | 81 | 6E | CD | 64 | F1 | 3D |
| C60 | F1 | 85 | FF | 98 | 22 | 8C | 3A | E1 | - | 35 | F0 | 3D | FE | 9C | 27 | C1 | 67 |
| C70 | B5 | 89 | 66 | 81 | 20 | CD | 6A | E1 | - | 2F | B0 | 89 | 34 | ED | 4F | 35 | 22 |
| C80 | 8C | 3A | 32 | 18 | 81 | 00 | CD | 20 | - | C0 | 3F | 9C | 7E | 34 | 9C | 7F | 35 |
| C90 | CA | 34 | 81 | 12 | CD | 6E | 81 | 01 | - | CD | 6C | 87 | 24 | 8C | 35 | C3 | 35 |
| CA0 | 87 | 32 | DC | FE | DB | 48 | 31 | CA | - | 34 | D9 | EA | DB | 48 | 21 | 22 | CE |
| CB0 | 6A | 37 | 8C | 3A | 32 | 1A | F9 | 2E | - | 13 | FE | 2E | 12 | FF | 2E | 9C | A9 |
| CC0 | 34 | 9C | AE | DB | 48 | 21 | CA | 34 | - | B0 | 89 | 6C | B5 | 89 | 6E | 81 | 23 |
| CD0 | C3 | 35 | 81 | 31 | 45 | CA | 34 | B9 | - | 89 | 6E | 81 | 22 | C3 | 35 | 81 | 30 |
| CE0 | 45 | C3 | 35 | 27 | CA | 34 | B6 | 89 | - | 6E | 81 | 28 | 45 | CA | 34 | 81 | 01 |
| CF0 | CD | 6C | 81 | 12 | CD | 6E | 81 | 2A | - | DB | 48 | 31 | CA | 34 | B0 | 89 | 6C |
| D00 | 81 | 02 | 89 | 6E | 83 | 2A | DC | 09 | - | CA | 6E | 81 | 27 | 45 | CA | 34 | 37 |
| D10 | D9 | 09 | 8C | 27 | 31 | 11 | 59 | DD | - | 09 | 89 | 6C | D9 | 9E | 8C | 27 | 33 |
| D20 | 12 | 9D | 3E | D9 | 30 | 9D | 47 | 85 | - | 00 | CE | 2A | 30 | DB | 48 | 1F | 48 |
| D30 | 31 | 9D | 49 | 89 | 26 | B6 | 89 | 6A | - | EC | 00 | CA | 34 | 9D | 61 | CE | 2A |
| D40 | 83 | 02 | DC | EA | 12 | D9 | 8E | DD | - | 0E | 89 | 6E | 83 | 26 | 3D | 13 | 8C |
| D50 | 6E | C4 | 83 | 6C | 8C | 26 | 3D | 14 | - | 8C | 6C | 89 | 26 | 81 | 26 | 45 | CA |
| D60 | 34 | BB | 89 | 6C | BE | 89 | 6E | 81 | - | 29 | 45 | CA | 34 | 81 | 90 | CD | 6C |
| D70 | 81 | 09 | CD | 6E | 81 | 2C | DB | 48 | - | 31 | 27 | FE | 9A | F1 | 7D | B0 | 89 |
| D80 | 8E | 89 | 3B | 22 | F3 | 3B | 0C | 19 | - | 81 | 01 | CD | 8C | 22 | 8C | 3A | 32 |
| D90 | 0B | FE | B2 | 21 | BF | 89 | DE | B3 | - | 89 | B3 | 81 | 05 | 81 | F0 | CD | E8 |
| DA0 | 81 | 00 | CD | 80 | DD | 41 | 20 | 83 | - | 00 | C4 | 82 | 0D | 21 | 83 | 10 | C4 |
| DB0 | 82 | D9 | 83 | 0B | B3 | 89 | 85 | 89 | - | E2 | 8C | F2 | DD | 3F | DD | 13 | DD |
| DC0 | 10 | 89 | 7E | 81 | 04 | CD | DC | 81 | - | 96 | CD | 2C | CD | 5C | B1 | 89 | 2A |
| DD0 | 89 | 26 | 89 | 25 | 89 | B5 | B2 | 89 | - | 24 | B6 | 89 | 32 | BB | 89 | 29 | 85 |
| DE0 | 80 | E8 | 84 | CD | 70 | 84 | CE | 7E | - | 30 | E8 | 84 | 40 | B0 | 89 | 7C | 83 |
| DF0 | 72 | E8 | 84 | 89 | 7E | 84 | E8 | 84 | - | 41 | 36 | 84 | D9 | A2 | 08 | DC | FC |
| E00 | CD | 7A | FF | BE | B7 | 89 | B6 | 81 | - | 70 | CD | E6 | BF | 89 | F4 | 81 | FC |
| E10 | CD | E8 | 89 | F2 | 89 | F3 | 81 | 00 | - | CD | DC | FE | 9B | FE | BE | 81 | 05 |
| E20 | CD | 88 | FF | 9A | 81 | 02 | CD | 8C | - | 58 | 89 | 8E | FE | AE | FF | B2 | E1 |
| E30 | 35 | D1 | 3E | 20 | D1 | EC | D1 | 3C | - | 21 | C1 | 39 | FF | 98 | F1 | 85 | 27 |
| E40 | 83 | 20 | 81 | E3 | EC | AA | 82 | 81 | - | DD | 24 | FF | FF | FF | FF | FF | FF |
| E50 | FF | FF | FF | FF | FF | FF | FF | FF | - | FF | FF | FF | FF | FF | FF | FF | FF |
| E60 | FF | FF | FF | FF | FF | FF | FF | FF | - | FF | FF | FF | FF | FF | FF | FF | FF |
| E70 | FF | FF | FF | FF | FF | FF | FF | FF | - | FF | FF | FF | FF | FF | FF | FF | FF |
| E80 | FF | FF | FF | FF | FF | FF | FF | FF | - | FF | FF | FF | FF | FF | FF | FF | FF |
| E90 | FF | FF | FF | FF | FF | FF | FF | FF | - | FF | FF | FF | FF | FF | FF | FF | FF |
| EA0 | FF | FF | FF | FF | FF | FF | FF | FF | - | FF | FF | FF | FF | FF | FF | FF | FF |
| EB0 | FF | FF | FF | FF | FF | FF | FF | FF | - | FF | FF | FF | FF | FF | FF | FF | FF |
| EC0 | FF | FF | FF | FF | FF | FF | FF | FF | - | FF | FF | FF | FF | FF | FF | FF | FF |
| ED0 | FF | FF | FF | FF | FF | FF | FF | FF | - | FF | FF | FF | FF | FF | FF | FF | FF |
| EE0 | FF | FF | FF | FF | FF | FF | FF | FF | - | FF | FF | FF | FF | FF | FF | FF | FF |
| EF0 | FF | FF | FF | FF | FF | FF | FF | FF | - | FF | FF | FF | FF | FF | FF | FF | FF |

FIG. 13

| | 0 | 1 | 2 | 3 | 4 | 5 | 6 | 7 | | 8 | 9 | A | B | C | D | E | F |
|---|---|---|---|---|---|---|---|---|---|---|---|---|---|---|---|---|---|
| F00 | FF | FF | FF | FF | FF | FF | FF | FF | - | FF | FF | FF | FF | FF | FF | FF | FF |
| F10 | FF | FF | FF | FF | FF | FF | FF | FF | - | FF | FF | FF | FF | FF | FF | FF | FF |
| F20 | FF | FF | FF | FF | FF | FF | FF | FF | - | FF | FF | FF | FF | FF | FF | FF | FF |
| F30 | FF | FF | FF | FF | FF | FF | FF | FF | - | FF | FF | FF | FF | FF | FF | FF | FF |
| F40 | FF | FF | FF | FF | FF | FF | FF | FF | - | FF | FF | FF | FF | FF | FF | FF | FF |
| F50 | FF | FF | FF | FF | FF | FF | FF | FF | - | FF | FF | FF | FF | FF | FF | FF | FF |
| F60 | FF | FF | FF | FF | FF | FF | FF | FF | - | FF | FF | FF | FF | FF | FF | FF | FF |
| F70 | FF | FF | FF | FF | FF | FF | FF | FF | - | FF | FF | FF | FF | FF | FF | FF | FF |
| F80 | FF | FF | FF | FF | FF | FF | FF | FF | - | FF | FF | FF | FF | FF | FF | FF | FF |
| F90 | FF | FF | FF | FF | FF | FF | FF | FF | - | FF | FF | FF | FF | FF | FF | FF | FF |
| FA0 | FF | FF | FF | FF | FF | FF | FF | FF | - | FF | FF | FF | FF | FF | FF | FF | FF |
| FB0 | FF | FF | FF | FF | FF | FF | FF | FF | - | FF | FF | FF | FF | FF | FF | FF | FF |
| FC0 | FF | FF | FF | FF | FF | FF | FF | FF | - | FF | FF | FF | FF | FF | FF | FF | FF |
| FD0 | FF | FF | FF | FF | FF | FF | FF | FF | - | FF | FF | FF | FF | FF | FF | FF | FF |
| FE0 | FF | FF | FF | FF | FF | FF | FF | FF | - | FF | FF | FF | FF | FF | FF | FF | FF |
| FF0 | FF | FF | FF | FF | FF | FF | FF | FF | - | FF | FF | FF | FF | FF | FF | FF | FF |

FIG. 14

ATHLETIC EVENT SCHEDULE WATCH

FIELD OF THE INVENTION

This is a continuation of U.S. patent application Ser. No. 08/724,363, filed Oct. 1, 1996. This invention relates generally to a portable electronic device for selectively displaying programmed scheduling information of events and will have specific but not limited application to athletic or sporting events.

IDENTIFICATION OF COPYRIGHT

A portion of the disclosure of this patent document contains material which is subject to copyright protection. The copyright owner has no objection to the facsimile reproduction by anyone of the patent document or of the patent disclosure as it appears in the public accessible Patent and Trademark Office patent file or records, but otherwise reserves all other rights of copyright.

BACKGROUND OF THE INVENTION

Sports fans desire easy access to information such as the location, participants, and date and time of sporting events. Conventional sources of such information include periodicals, television and radio broadcasts, and team schedule cards. Periodicals and broadcasts provide inadequate information delivery for various reasons. A typical sports page or news broadcast covers only the events of the preceding day, the current day, and the following day, leaving the fan unable to plan for future events. The fan must repeatedly consult these sources by purchasing additional periodicals or watching subsequent broadcasts. Also, the information content is over-inclusive from the perspective of a focused sports enthusiast. Periodicals and broadcasts provide information on all participants of a variety of sports. Much of this information is irrelevant to a fan interested in the schedule of a single participant. Moreover, the information has poor portability characteristics. Intact periodicals are bulky. Disassembled periodicals, such as individual newspaper pages, are delicate and easily misplaced. Obviously, information delivered through broadcast media is fleeting and cannot be subsequently consulted or transported.

Team schedule cards are undesirable because they use very small print and are difficult to read. The cards are easily damaged and misplaced. The fan must remember to carry the card even though, much of the time, it serves no useful purpose.

Some of the disadvantages of these conventional information sources are overcome by portable electronic devices capable of storing information. Conventional devices, such as electronic day planners, can store long-term information of specific interest. However, the user must provide all of the stored information and carry out the often complicated, time-consuming task of entering the data into the device. The more comprehensive the information, the longer it takes to program, the greater the likelihood for error, and the more difficult it is to access.

SUMMARY OF THE INVENTION

The present invention provides a pre-programmed, portable electronic device, which also serves as a timepiece, for displaying daily schedule information of a particular sports team including the dates, times, locations, and participants of events involving that team, and selectively displaying past and future scheduling information. The device comprises, in one form thereof, a display contained in a wristwatch housing, a plurality of switches, and a processor coupled to the display which receives inputs from the switches. The processor includes a timer to measure elapsed time, and a memory which stores the schedule data and the application program which controls the operation of the processor. The device provides a continuous display of the date and time in addition to information about the location, opponent, and start time of any game or match on that day involving the particular sports team. The user can manipulate the switches to sequentially review past information and preview future information. An alarm automatically alerts the user when a game or match begins.

Accordingly, an object of this invention is to provide a portable electronic device which displays scheduling information for sporting events according to the user's commands.

Another object of the present invention is to provide a portable electronic device which automatically provides a daily summary of the currently scheduled game activity for a desired team.

Still another object of the invention is to provide a portable electronic device which permits the user to review and preview the scheduled game activity of a desired team.

Yet another object of the invention is to provide a portable electronic device which alerts the user when a scheduled game begins.

BRIEF DESCRIPTION OF THE DRAWINGS

The above-mentioned and other objects and advantages of this invention, and the manner of attaining them, will become more apparent and the invention will be better understood by reference to the following description of embodiments of the invention taken in conjunction with the accompanying drawings, wherein:

FIGS. 9–14 are listings of the memory contents of the device according to the present invention.

Figure 1:
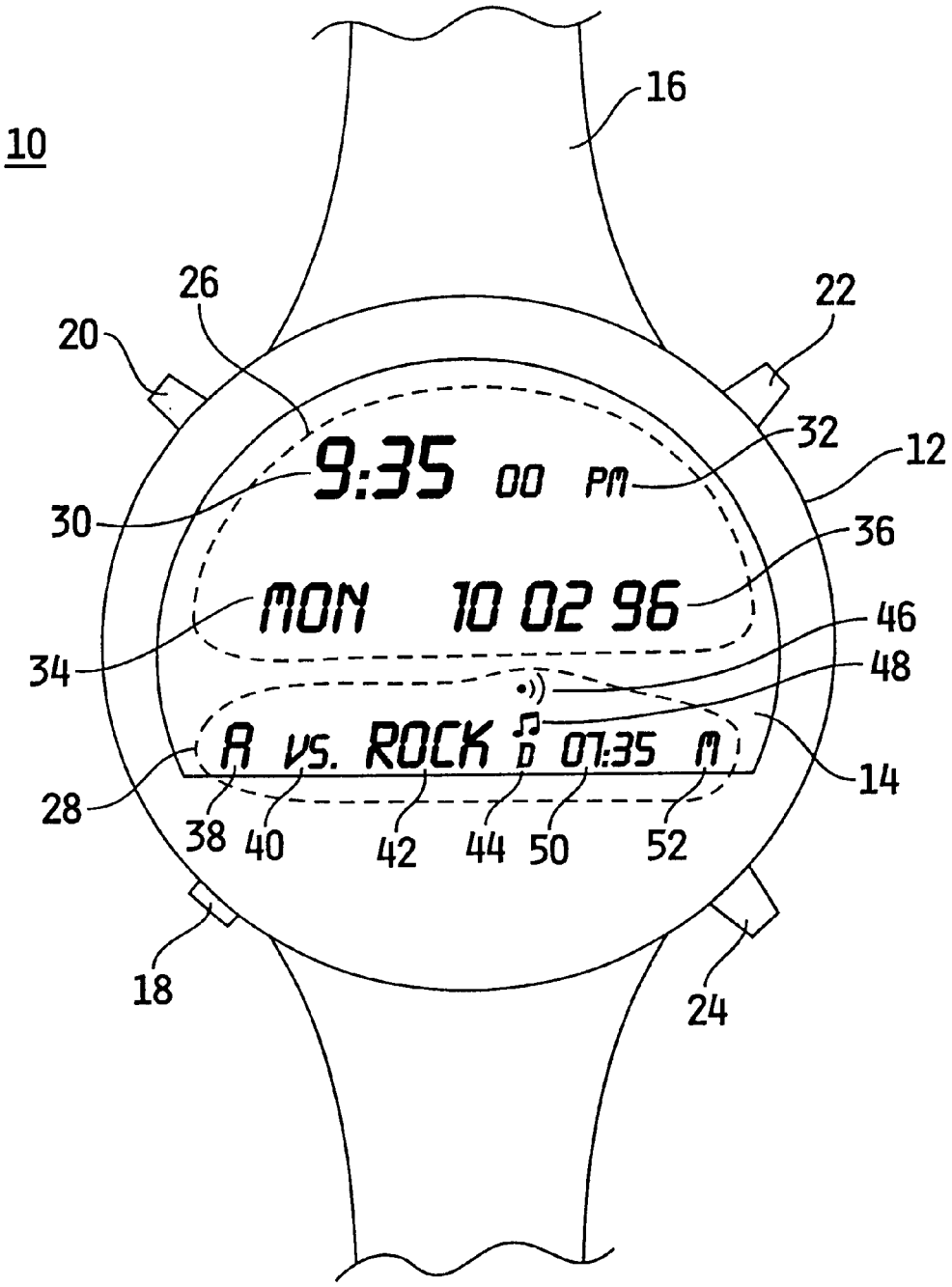
FIG. 1 is a face view of the device of the present invention illustrating the normal display mode of operation.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out below illustrate embodiments of the invention, in several forms, and such exemplifications are not to be construed as limiting the scope of the invention in any manner.

DESCRIPTION OF THE INVENTION

The embodiments disclosed in the detailed description below are not intended to be exhaustive or to limit the invention to the precise forms disclosed. Rather, the embodiments selected for the description are disclosed so that others skilled in the art may utilize their teachings.

FIG. 1 shows a portable electronic device 10 packaged as a wristwatch including housing 12, display 14 and band 16. Extending into housing 12 are push-button switches including select switch 18, set switch 20, forward switch 22, and reverse switch 24, the operation of which will hereinafter be described.

In an exemplary embodiment, display 14 is a TN type ⅛ duty cycle, multiplexed liquid crystal display. Display 14 is divided into an actual time are 26 (shown for illustration purposes with broken lines) and an event data are 28 (also shown with broken lines). Actual time area 26 includes a time region 30 for displaying the time of day, an AM/PM indicator 32, a day region 34 for displaying a three-letter abbreviation of the day of the week, and a date region 36 for displaying the year, month, and day of the month. Event data area 28 includes location region 38, "VS" (versus) symbol 40, opponent region 42, special circumstances region 44, miscellaneous alarm indicator 46, event alarm indicator 48, start time region 50, and time zone region 52. Location region 38 displays the symbol "H" or "A" to indicate home and away games respectively. The "VS" symbol is always displayed when display 14 is displaying a page of information corresponding to a scheduled event. Opponent region 42 displays a four-letter abbreviation of the name of the opposing team. Special circumstances region 44 displays the symbol "D" to indicate double-header games. Miscellaneous alarm indicator 46 and event alarm indicator 48 either contain the symbols shown in FIG. 1 or are blank, depending upon the device settings as hereinafter described. Start time region 50 displays the hour and minute corresponding to the starting time of the match. Time zone region 52 displays a one-letter abbreviation of the time zone corresponding to the starting time.

Figure 3:
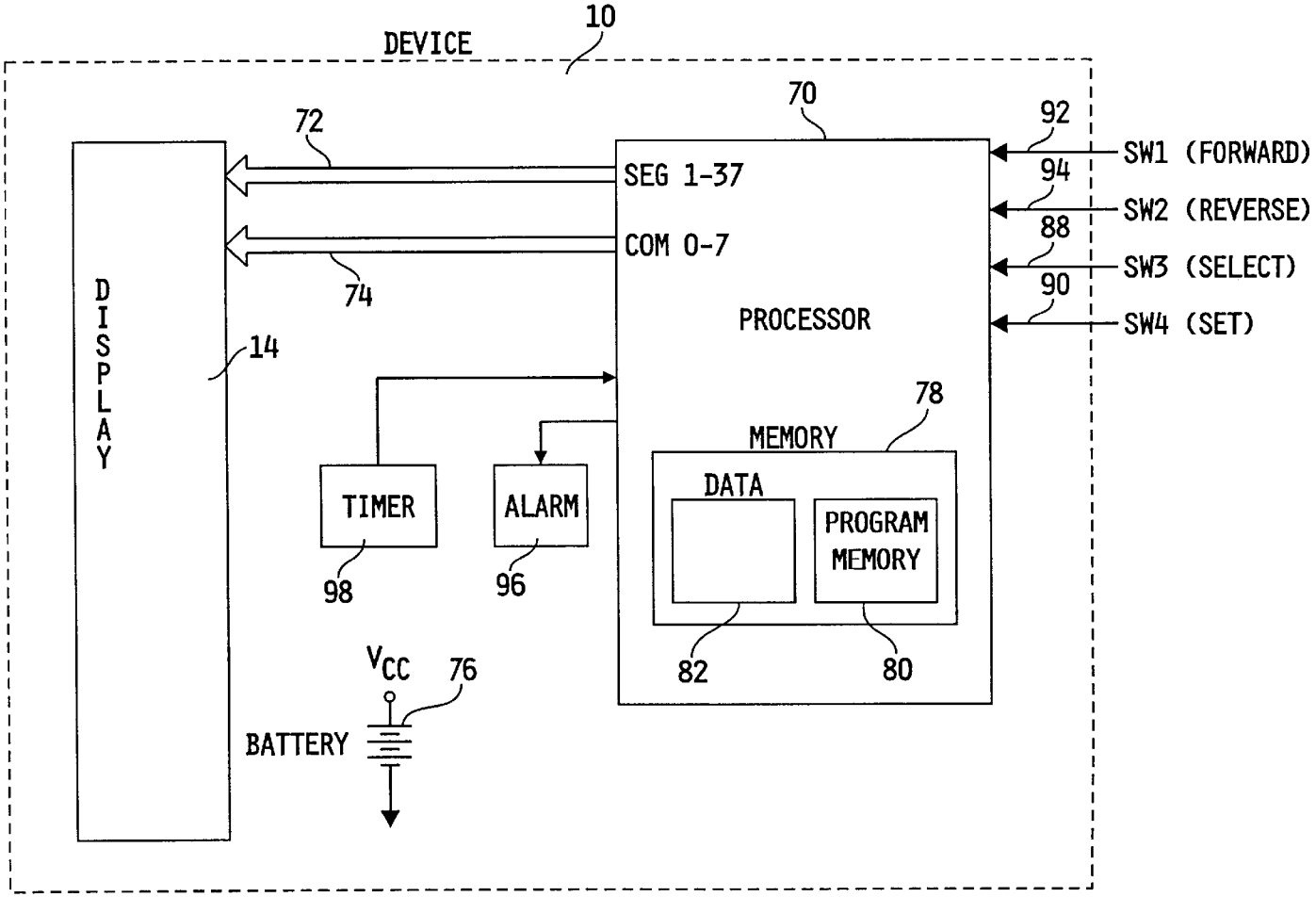
FIG. 3 is a block diagram of the device in the present invention.
Figure 4:
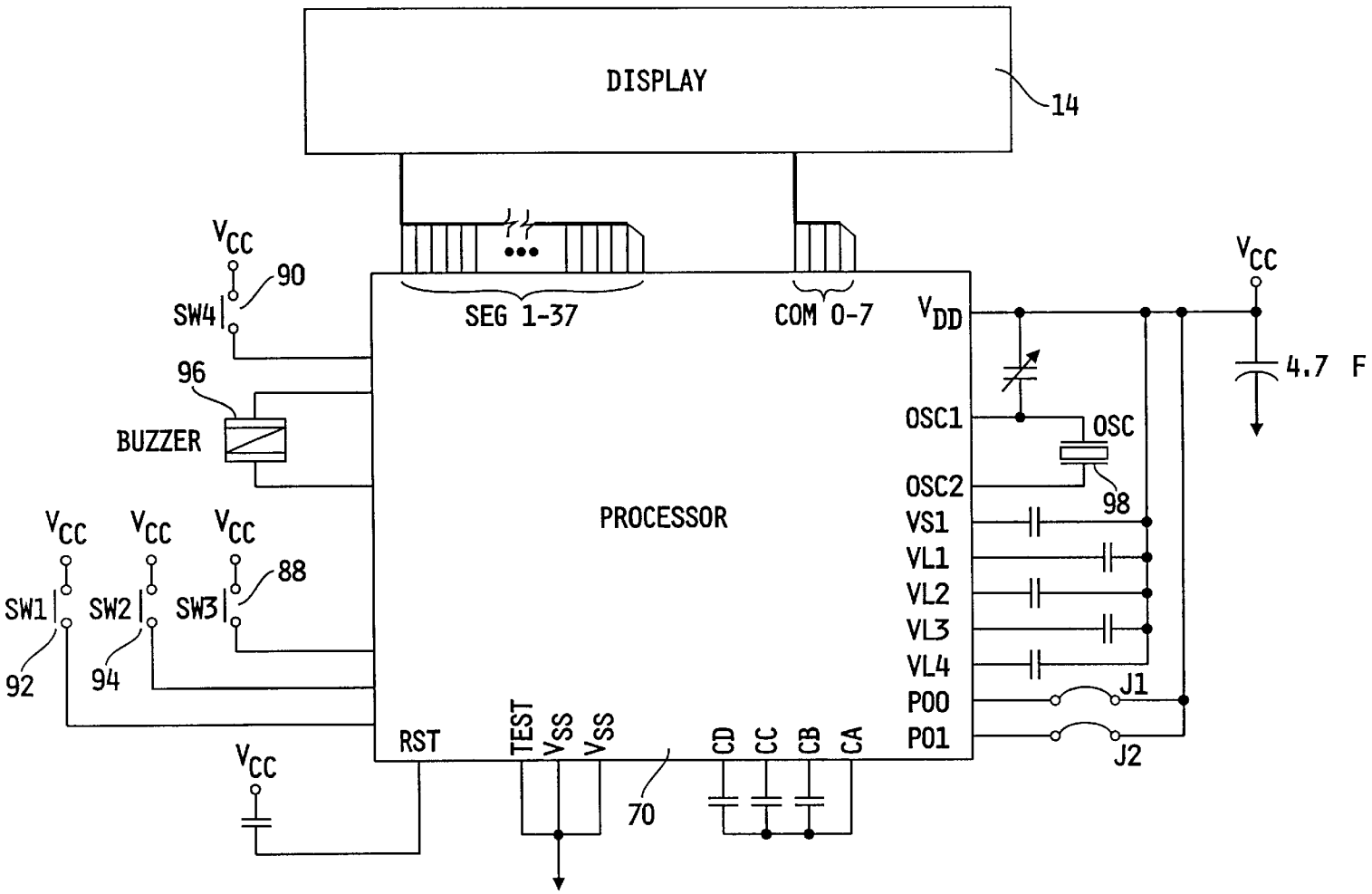
FIG. 4 is a detailed schematic diagram of the present invention.

As shown in the block diagram of FIG. 3, device 10 includes a processor 70 or micro-controller, which, in an exemplary embodiment, is a 4-bit single-chip device with a ⅛ duty cycle direct, 320 segment display drive (such as Samsung Part No. KS57C2504). Processor 70 is connected to display 14 over segment driver lines 72 and COM lines 74. A battery 76 provides power (Vcc) to device 10. Processor 70 includes a 4000 byte internal ROM memory 78 which contains application program 80 and data representing schedule information 82. FIGS. 9–14 provide an example of the contents of memory 78. Switches 88, 90, 92 and 94 are connected to select switch 18, set switch 20, forward switch 22, and reverse switch 24 respectively. An alarm 96 and an oscillator 98 are connected to processor 70.

Figure 2:
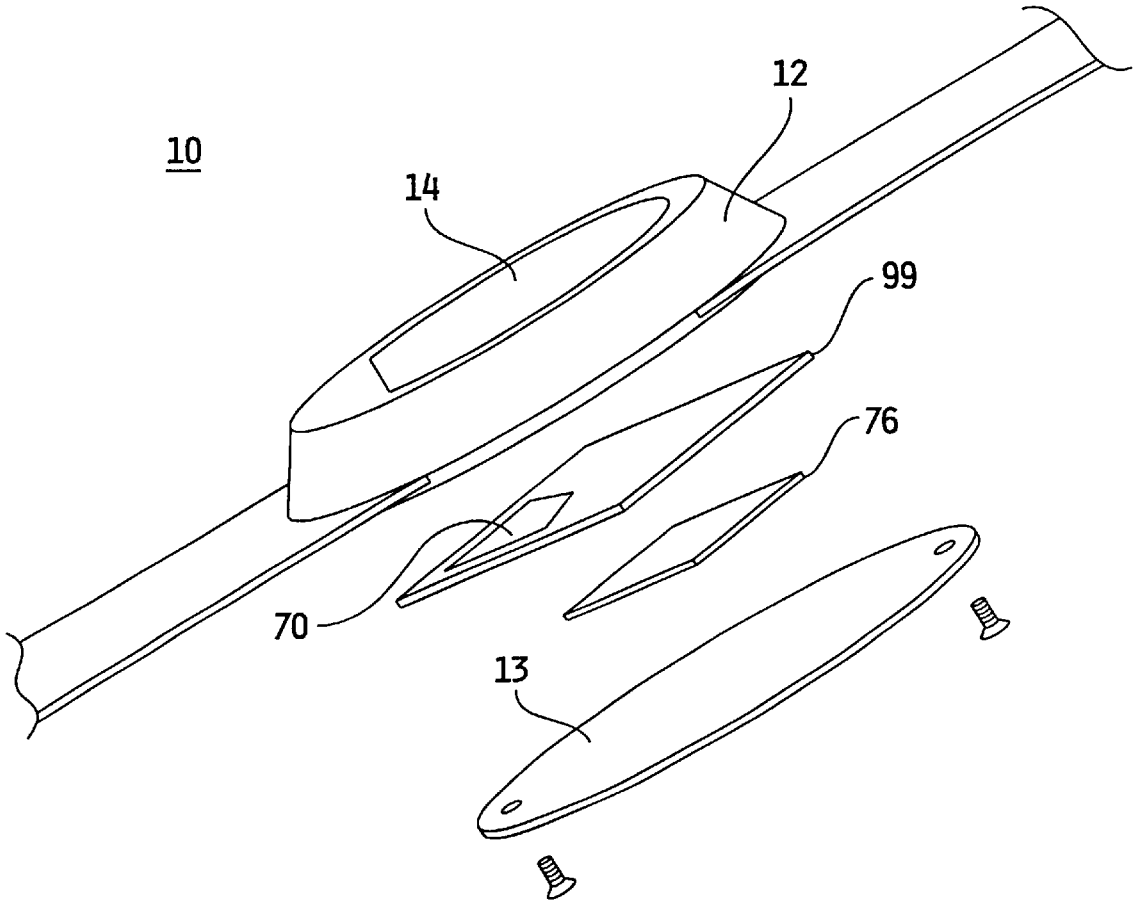
FIG. 2 is an exploded perspective view of the device of the present invention.

As seen in FIG. 2, housing 12 includes a removable backplate 13 which permits access to a module 99 which contains processor 70 and battery 76. Since module 99 is removable, processor 70 and battery 76 can be replaced. Of course, one skilled in the art could readily select an appropriate memory and design module 99 such that memory 78 of processor 70 could be re-programmed with schedule information using standard programming techniques.

MODE OF OPERATION

During assembly, memory 78 is loaded with schedule information 82 and application program 80 using a standard memory programming device and procedures well known in the art. Schedule information 82 for the purpose of this description relates to a selected baseball team and includes data describing all games scheduled for that particular season involving the team. It should be apparent to one skilled in the art that schedule information for teams or individual players of other sports could be programmed into memory 78. Associated with each game is data indicating the location of the game (i.e., whether "home" or "away"), the selected team's opponent, the starting time of the game, the time zone corresponding to the starting time, and whether the game is a double-header. The data is arranged in memory 78 by calendar day. The first and last calendar days that contain a corresponding page of schedule information indicate the first and last days of the season, respectively. Any calendar day between those dates which does not contain a corresponding page of schedule information (i.e., a game is not scheduled for that day), is an "off" day as explained below.

After processor 70 is programmed and installed, power applications (i.e., connection to battery 76) causes program 80 to execute an initialization sequence. During the initialization sequence, program 80 enables processor 70 to generate default values corresponding to actual time, date, day of the week, and alarm time. Timer 98 then begins incrementing this data in a manner well known in the art. During initialization, program 80 also writes data to memory 78 to indicate that the miscellaneous alarm is disabled, and the event alarm is enabled.

Device 10 has several modes of operation including normal display mode (FIG. 1), alarm display mode (FIG. 5), schedule viewing mode (FIG. 6), time setting mode (FIG. 7), alarm setting mode (FIG. 8), and a dormant mode. Immediately upon completion of the initialization procedure, program 80 enters the normal display mode and processor 70 to generate a display of information on display 14 similar to that shown in FIG. 1. Before device 10 is shipped for distribution and sale, processor 70 is preferably put in dormant mode to extend the life of battery 76. To enter dormant mode, switches 20, 22 and 24 are pressed simultaneously and held for at least two seconds. Program 80 interprets such an input as a command to disable display 14. The purchaser or user of device 10 causes the device to return to normal display mode by again pressing and holding switches 20, 22 and 24.

Figure 7:
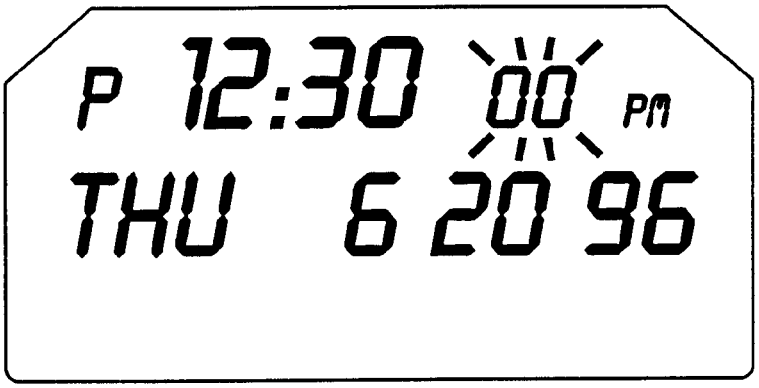
FIG. 7 shows the display of the present invention when operating in time setting mode.

At some later time if the processor is in a dormant mode, or prior to use, either the distributor or the user sets the actual time. Device 10 enters time setting mode when select switch 18 is actuated. Select switch 18 is protected from accidental actuation by a button guard and is actuated using a pointed object such as a pen. Program 80 interprets select input signal 88 as a command to enter the time setting mode. When device 10 is in time setting mode, processor 70 enables display 14 to clear all contents of event data area 28 as shown in FIG. 7. The seconds portion of the actual time data flashes on and off. If the user presses forward switch 22, the seconds portion is reset to zero. All data for display in actual time area 26 is modified by first pressing the set switch 20 to select the data region (causing it to flash), then incrementing or decrementing the data by pressing forward switch 22 or reverse switch 24, respectively. If while in the time setting mode, processor 70 receives an input 88 from select switch 18, device 10 exits time setting mode and enters normal display mode. The device also exits time setting mode and enters normal display mode after the time setting sequence is completed or if none of the three switches 20, 22 and 24 are pressed for at least ten seconds.

During normal operation, device 10 remains in normal display mode. At the beginning of each day, when actual time reaches 12:00:00 AM, program 80 accesses memory 78 to retrieve a page of schedule information 82 corresponding to the current calendar day. A page of information is all information describing the event scheduled for a particular day. The new or current page of information is displayed in event data area 28 according to the predetermined format shown in FIG. 1. If memory 78 does not contain a page of information corresponding to the current calendar day (i.e., no game is scheduled for that day), and the current calendar day falls between the first and last events stored in memory 78 (i.e., the season is still on), program 80 enables processor 70 to generate the message "DAY OFF" for display on display 14 in event data area 28. If the current day is before the first day of the season or after the last day, but before the first day of the next year, program 80 enables processor 70 to generate the message "SEASON OFF" in the event data area 28 of display 14. On the first day of the calendar year following the pre-programmed season, and for all days thereafter, program 80 enables process 70 to generate the message "GAME DAY" in event area 28.

Alarm 96 functions both as an event alarm and a miscellaneous alarm. If the event alarm function of device 10 is enabled, processor 70 generates the musical symbol shown in FIG. 1 in event alarm indicator location 48. As timer 98 advances the actual time data stored on memory 78 and displayed in actual time area 26, program 80 compares the data to the start time data displayed in start time region 50. When the start time data matches the actual time data, program 80 enables processor 70 to activate alarm 96. In an exemplary embodiment, processor 70 sends a sequence of signals to alarm 96 which generates a series of tones such as to the well-known tune "Take Me Out to the Ball Game" to remind the user that the scheduled game for the day is beginning. Alarm 96 continues playing the tune for approximately twenty-five seconds or until any one of the switches 18, 20, 22, 24 is actuated. If the event alarm function is disabled, event alarm indicator location 48 is blank and the event starting data is ignored for purposes of activating alarm 96.

Similarly, if the miscellaneous alarm function is enabled, processor 70 generates the symbol shown in FIG. 1 in miscellaneous alarm indicator location 46. Program 80 compares the actual time data as it is updated according to timer 98 to the miscellaneous alarm time data storage in memory 78. When the actual time data equals the miscellaneous alarm time data, program 80 enables processor to activate alarm 96 by sending a series of signals which can generate a "beep-beep" sound. Alarm 96 continues to produce the "beep-beep" sound for approximately fifteen seconds or until set switch 20 is actuated. If the miscellaneous alarm function is disabled, miscellaneous alarm indicator location 46 is blank and the miscellaneous alarm data stored in memory 78 is ignored.

Figure 5:
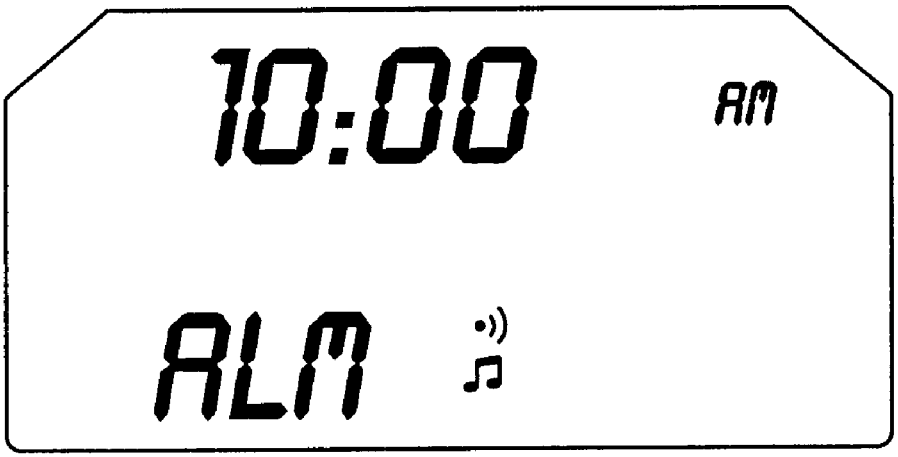
FIG. 5 shows the display of the present invention when operating in alarm display mode.
Figure 8:
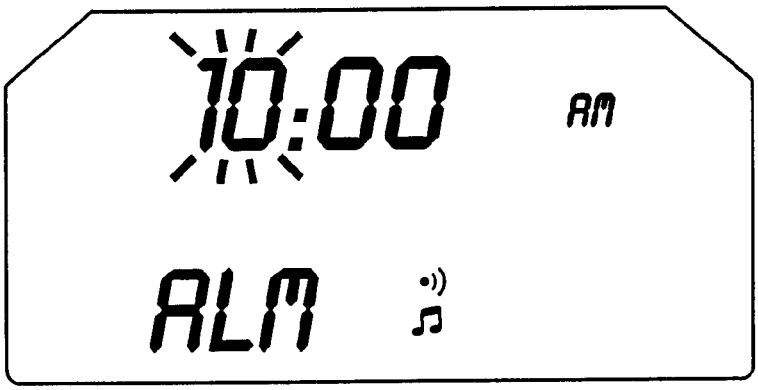
FIG. 8 shows the display of the present invention when operating in alarm setting mode.

The miscellaneous alarm time data is changed by entering alarm setting mode. The user first presses the set switch 20 to command program 80 to enter the alarm display mode. Processor 70 causes display 14 to display the alarm time and the characters "ALM" as shown in FIG. 5. While in alarm display mode, the user can enable and disable the vent alarm function and the miscellaneous alarm function by pressing the reverse switch 24 or the forward switch 22, respectively. The user enters the alarm setting mode by pressing select switch 18 while in the alarm display mode. The desired alarm hour, minute, and AM/PM are selected (and displayed as flashing) by pressing set switch 20 as shown in FIG. 8. The data is incremented or decremented by pressing forward switch 22 or reverse switch 24 in a manner similar that described above in the description of setting the actual time data. As with the actual time setting mode, the user exits the alarm setting mode by pressing the select switch 18, completing the setting sequence, or doing nothing for at least ten seconds.

Figure 6:
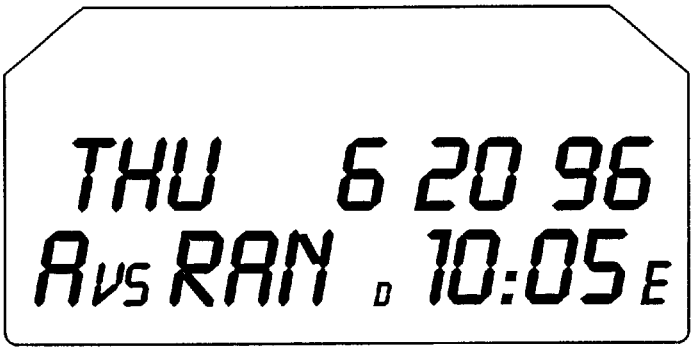
FIG. 6 shows the display of the present invention when operating in schedule viewing mode.
Figure 6:
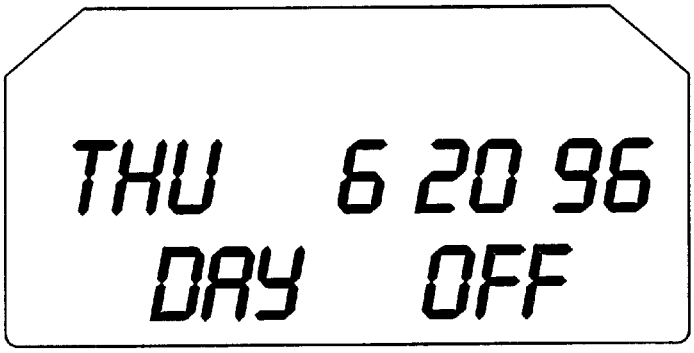
Figure 6:
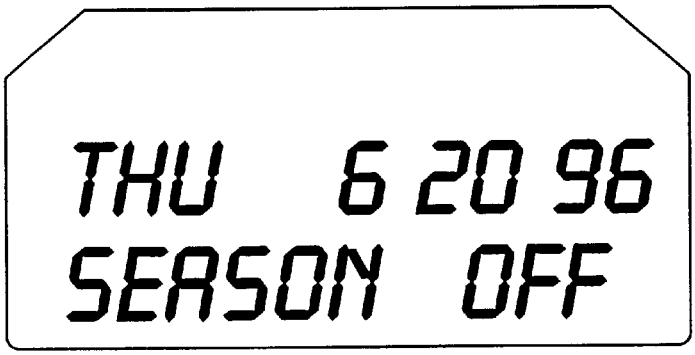

Referring now to FIG. 6, the schedule viewing mode is entered whenever the user desires information about games scheduled for any day of the year other than the current calendar day. The schedule viewing mode is entered from the normal display mode by pressing either the forward switch 22 or the reverse switch 24. When either switch is pressed, program 80 enables processor to clear actual time region 30 of display 14. When the forward switch 22 is pressed, the program 80 causes processor 70 to access the portion of memory 78 corresponding to the calendar day following the current calendar day. If a page of schedule information exists in that portion of memory 78, processor 70 causes the page of information to be displayed in event data area 28 according to the pre-determined format of FIG. 1. The data displayed in day region 34 and date region 36 is also advanced by one day. Each time the forward switch 22 is pressed, the data displayed in day region 34 and date region 36 is advanced by one day and program 80 causes processor 70 to access a page of schedule information in memory 78 corresponding to the displayed calendar day. The page of information is displayed in event data area 28. If no match is scheduled for the displayed day, the message "DAY OFF" is displayed in event data area 28 as shown in FIG. 3. If the displayed day is not within the season programmed into memory 78, but is prior to the first day of the following year, the message "SEASON OFF" is displayed in event data area 28. Event data area 28 continuously displays the message "GAME DAY" after the year corresponding to the programmed season. The user similarly reviews past scheduling information or decrements the displayed information by one day by pressing the reverse switch 24.

The user can advance the displayed schedule information in one month increments by pressing set switch 20 while in the schedule viewing mode. Each time set switch 20 is actuated, program 80 interprets input signal 90 as a command to advance to the page of information stored in memory 78 corresponding to the first day of the following month. Inputs from forward switch 22 or reverse switch 24 increment or decrement the displayed page of information by one calendar day as described above. By using a combination of the set switch 20, the forward switch 22 and the reverse switch 24, the user can quickly access scheduling information for any day of the year.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A portable electronic device for selectively displaying scheduling information of events including dates, times, locations and participants of the events, said device comprising:

a display on which pages of information are individually shown, each of said pages containing event scheduling information corresponding to a different calendar day;

a processor coupled to said display, said processor including means for determining the current calendar day, a memory in which said pages of information are stored, and a program, said program enabling said processor to cause said display to show a selected page of information corresponding to the current calendar day;

said memory including an actual time location for storing data representing the actual date and time, said means for determining the current calendar day including clock means for producing a clock pulse corresponding to actual time, said means for determining the current calendar day sensing said clock pulse to periodically update said actual date and time data;

a miscellaneous alarm coupled to said processor, said memory including an alarm time location for storing data representing a miscellaneous alarm date and time, said program enabling said processor to activate said miscellaneous alarm when said miscellaneous alarm date and time correspond to said actual date and time;

a mode switch coupled to said processor, said mode switch generating a mode input signal when actuated, said program entering a miscellaneous alarm data viewing mode for fixed period of time following actuation of said mode switch, said miscellaneous alarm data viewing mode enabling said processor to respond to said mode input signal by causing said display to show said miscellaneous alarm date and time data;

a first switch and a second switch coupled to said processor; said program entering a schedule viewing mode for fixed time period following actuation of one of said first switch and said second switch, said schedule viewing mode enabling said processor to respond to said mode input signal by causing said display to show a page of information corresponding to the first calendar day of the month containing the current calendar day.

2. The device of claim 1 wherein said schedule viewing mode enables said processor to respond to a series of said mode input signals by causing said display to show a series of said pages of information, each said mode input signal of said series of mode input signals respectively corresponding to one of said pages of information of said series of pages, each of said series of pages corresponding to the first calendar day of a separate month.

3. The device of claim 1 wherein said program enters a miscellaneous alarm set mode if said set switch is actuated when said program is in said miscellaneous alarm data viewing mode, said miscellaneous alarm set mode enabling said processor to manipulate said miscellaneous alarm date and time in response to said input signals, said second input signals, and said mode input signals.

* * * * *